US006290598B1

(12) United States Patent
Jones et al.

(10) Patent No.: US 6,290,598 B1
(45) Date of Patent: Sep. 18, 2001

(54) AIR DIFFUSER HAVING FIELD CHANGEABLE AIR CONTROL BLADES

(75) Inventors: Gordon G. Jones; Gerald Cook, both of Tuscon, AZ (US)

(73) Assignee: Air System Components LP, Dayton, OH (US)

( * ) Notice: Subject to any disclaimer, the term of this patent is extended or adjusted under 35 U.S.C. 154(b) by 0 days.

(21) Appl. No.: 09/484,959

(22) Filed: Jan. 18, 2000

(51) Int. Cl.[7] ..... F24F 7/00

(52) U.S. Cl. ..... 454/303

(58) Field of Search ..... 454/303, 284, 454/292, 301, 330, 331

*Primary Examiner*—Harold Joyce
*Assistant Examiner*—Derek S. Boles
(74) *Attorney, Agent, or Firm*—Shughart Thomson & Kilroy P.C.

(57) ABSTRACT

A diffuser having side rails and bridges includes different sets of air control blades that are interchangeably mounted on and slidable along slots located in the bridges. The different sets of blades may be interchanged without disassembly of a remainder of the diffuser.

9 Claims, 3 Drawing Sheets

AIR DIFFUSER HAVING FIELD CHANGEABLE AIR CONTROL BLADES

BACKGROUND OF THE INVENTION

The present invention is directed to slot air diffusers or air bars that control air flow from a ventilation system into a room and, in particular, to an air diffuser that includes sets of different types of air flow control blades that are interchangeable after the diffuser is assembled without disassembly of the diffuser and, especially, wherein the blades are interchangeable after installation in an architectural environment without disassembly of the diffuser or the surrounding room structure.

Slot type air diffusers are used in many different environments for controlling air flow into a room from a heating and cooling ventilation system. Sometimes the particular requirements for air flow into a room require that the air flow be a jet type flow that has a relatively high velocity and projects substantially directly out of the diffuser and generally perpendicularly with respect to the surface upon which the diffuser is mounted. Other situations require that the air be diverted to one side or the other of the diffuser or may require that the air be directed to both sides of the diffuser. Also, it may become desirable to modify the volume of air flow between full flow of air through the diffuser and a dampened air flow. Often, the architect or engineer designing the facility determines what type of air flow will be necessary for a particular diffuser and a diffuser is designed to provide that flow. In some instances the installer may make the determination as to what will work best at the time of installation.

The present invention is especially useful where it is necessary for the installer to make the decision as to what to install at the site or where a change must be made to an already assembled unit. That is, the present invention provides sets of different types of air control blades that allow for different types of air flows, for example, a jet stream or alternatively a more diffuse and side directed flow of air, depending upon the particular requirements at hand.

Furthermore, it is often necessary to either repair the diffuser or to modify a diffuser from one type of air flow to another after installation of the diffuser, when the heat and cooling loads surrounding the diffuser have changed or personnel locations have changed. Also, it is advantageous to provide a diffuser that has easily changeable blades that can be interchanged at a warehouse or distribution point, so that if the seller or distributor is out of a diffuser in a particular configuration, then persons at the warehouse can easily convert the diffuser to a different configuration without a substantial amount of work.

Therefore, it is desirable to have a diffuser for which different sets of blades are available, wherein at least one set of the blades allows for substantial directional control of the air flow to the side and another set of blades allows for a jet air flow from the diffuser. Also, it is important that the blades be easily removable once the diffuser has been installed in the ceiling, wall or the like, without disassembly of the diffuser or the structure in which it is installed. That is, the blades should be capable of being easily removed by manual manipulation with or without help of a simple tool to help urge the blades to one side of the diffuser for removal purposes. To allow easy removal, the diffuser must include a bridge that will support the blades in such a manner that the blades may be moved relative to the bridge from a support configuration to a removal configuration in an easy and simple manner, while the bridge remains supported by the remainder of the diffuser.

SUMMARY OF THE INVENTION

A slot air diffuser is provided that includes a pair of spaced and parallel side rails that are joined therealong by at least one pair of bridges. The bridges are mounted so as to be securely held and supported by the side rails, but slidable along the length of the rails. Each of the bridges also includes a blade receiving slot and a blade biasing spring mounted near a rear of the slot of each bridge.

The diffuser further includes at least one control blade. Preferably, there are at least two different alternative and interchangeable sets of pairs of air control blades associated with the diffuser. Although in accordance with the invention multiple different types of air control blades can be used in an overall single diffuser configuration having multiple air diffusion slots, normally only one type of the blades is used at a time between each pair of adjacent bridges. The blades mount in the slots of the bridges and extend between the bridges during use. The slot of each bridge is elongate and extends laterally between the side rails to allow the blades to be laterally positionally adjusted therealong.

A first set of the blades includes an air direction and volume control blade having a substantially planar portion that is attached along an edge thereof to an elongate rod of somewhat larger diameter that extends beyond the planar portion so as to form slot following pegs at opposite ends of the blade. Both of the pegs of the planar portion of the first type of blade are received in and supported by the respective bridge slots such that the first type of blade is normally positioned to extend side to side or perpendicularly with respect to the flow of air through the diffuser. The first type of blades are normally used in pairs that at least partially overlap each other and are slidable back and forth in the bridge slot, from side to side both as an overlapped pair or individually to increase or decrease the overlap between the blades. The blades in this way may be selectively overlapped or spread relative to one another so as to decrease, or alternatively, increase the aggregate spacing between the blades and both of the side rails. In this manner air flow volume and the outflowing air directional distribution pattern can both be controlled by adjustment of such blades in the diffuser.

The side rails also include a lower flange that extends perpendicular to a side wall of a respective side rail and inwardly toward a flange of the opposite side rail. The first blades work in cooperation with the side rail, side wall and flange to direct air flow as air exits the diffuser to one side of the diffuser, to the opposite side of the diffuser or alternatively to a pattern that is somewhere in between. The first type of the blades function to control both volume of air passing through the diffuser and direction of air emanating from the diffuser.

The second set of blades also includes a planar portion that has on the one side thereof, a rod that extends beyond the planar portion and which is received in the slots. However, in the second set of blades the planar portion hangs generally parallel to the flow of air through the diffuser and more particularly down from the rod supporting the blade so as not to be received in the bridge slots during operation, although pegs on the ends of the rods are supported by and slide along the bridge slots to allow lateral adjustment. Attached to the edge of the planar portion of each of the second blades opposite the rod is a foot that extends perpendicularly from the planar portion. The foot is received on an associated side rail flange in such a manner as to cooperate in stabilizing the blade while air passes the blade. The second set of blades is especially well adapted for providing a jet flow of air through the diffuser. All of the blades are adjustable by lateral movement of each blade along the bridge slots, normally by manual manipulation.

The diffuser is normally installed with either the first set of blades or the second set of blades; however, there may be multiple air slots, each requiring a set of blades which may be the same or different, as required by the environment. If it is later determined that a different set of blades is required because of a change in the surrounding environment or the like, each blade of an installed set of blades is individually biased to one side so as to be urged deeper into the bridge slot of that side than occurs during normal operation. This releases the opposite end of the blade from the slot so that it can fall or be drawn downwardly and be withdrawn by the technician. For the second type of hanging blade, the blade is first rotated ninety degrees or sideways so the planar portion of the blade aligns with the bridge slot. In this manner the first set of blades may be removed and in a reverse manner a second set of blades is installed.

OBJECTS AND ADVANTAGES OF THE INVENTION

Therefore, the objects of the present invention are: to provide a slot air diffuser having side rails joined by bridges that support alternative interchangeable sets of air flow control blades; to provide such a diffuser that includes at least one set of blades which are positioned horizontal (side to side in non-ceiling units) or generally perpendicular to air flow in the diffuser and a second set of blades that are positionable vertical (top to bottom of the diffuser in non-ceiling mounted units) or generally parallel to air flow within the diffuser to provide for control of different types of air flow from the diffuser; to provide such a diffuser wherein one of the sets of blades include planar panels, the ends of which are received in slots in the bridges, and a spring mechanism for biasing the blades to slide without wedging, hold the blades in proper position so as to be supported by the bridge and to maintain a slight bias on the blades to prevent them from rattling and making noise during use; to provide a diffuser having a second set of blades that are hung from the bridge slots and include feet for stabilizing each blade by interacting with and sliding along side rail bottom flanges; to provide such a diffuser wherein the blades are easily changed from one type of blade to the other during installation, during warehousing, and, especially, when modification is necessary in the field; to provide such a diffuser wherein the blades are easily changed without disassembly of the diffuser and without disassembly of the structure surrounding the diffuser; to provide such a diffuser wherein structure associate with the side rails, especially a bottom flange, works in conjunction with the different types of air control blades to provide proper air flow and to help stabilize vertically aligned blades; and to provide such a diffuser which is especially easy to assemble, has relatively few parts, is easy to install, is inexpensive to produce and is especially well suited for the intended usage thereof.

Other objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

DETAILED DESCRIPTION OF THE INVENTION

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Figure 1:
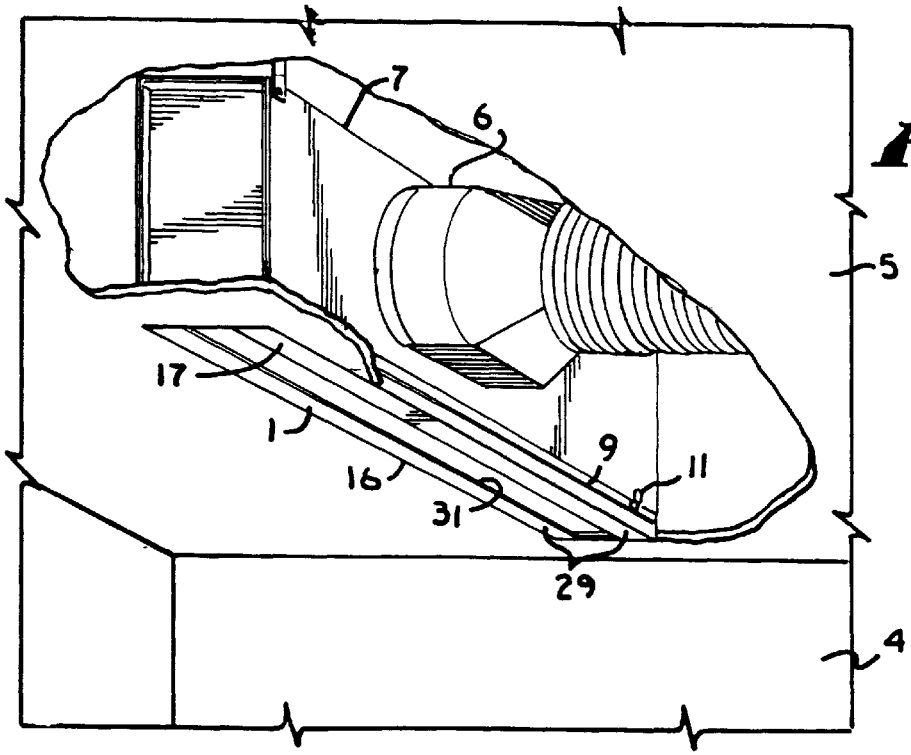
FIG. 1 is a perspective view of a slot air diffuser in accordance with the present invention shown mounted to receive air from a heating and cooling ventilation plenum and being further mounted in a ceiling of a room, with portions broken away to show detail thereof.

The reference in numeral 1 generally designates an air bar or slot air diffuser in accordance with the present invention. The diffuser 1 is shown in FIG. 1 in a room 4. The room 4 has a ceiling 5 with an air distribution plenum 6 located above the ceiling 5 opening into a boot 7. The boot 7 has a flange 9 that mates with the diffuser 1 and a plurality of snaps or fasteners 11 which secure the diffuser 1 to the plenum 6 and, in particular, to the boot 7. In this manner air being distributed by the plenum 6 is supplied to the top or plenum facing side 12 of the diffuser 1. As used herein the terms top and bottom refer to the flow of air through the diffuser 1 with the top plenum facing side 12 being at the top and the opposite or air dispensing side being at the bottom, since such diffusers 1 can be installed sideways in a wall or the like.

The diffuser 1 includes a pair of side frame rails 16 and 17 joined at opposite ends by end plates 18. The diffuser 1 also includes a pair of bridges 22 and an initial installed or first pair of air pattern controller blades 23.

The frame rails 16 and 17 are generally elongate and each have a sidewall 28 and a bottom flange 29 that extends outwardly from the lower or outer most edge of a respective side wall 28 in a facing relationship to each other, but spaced so as to form a slot 31 therebetween that is sufficiently wide to receive one of said blades sideways therethrough. Each side wall 28 has an interior surface 33 such that the surfaces 33 of opposed side walls 28 face each other. Likewise, each bottom flange 29 has an inward facing or interior surface 34 that is generally perpendicular to the overall flow of air through the diffuser 1 from top to bottom.

The surfaces 33 and 34 cooperate with the first pair of blades 23 to control the directional flow of air through the diffuser 1. Each side wall 28 also includes upper and lower facing flanges 36 and 37 that cooperate to form a receiver 38 within which opposite sides of each of the bridges 22 are received in such a manner so as to allow the bridges 22 to be slidably positioned along the rails 16 and 17.

Each of the bridges 22 is sized and shaped to span between a pair of opposed side rails 16 and 17. Each of the bridges 22 has a pair of feet 41 and 42 (see FIG. 9) that extend in opposite directions at opposite ends thereof and that are sized and shaped to be slidably received in and supported by the receivers 38. The bridges 22 are thus supported by the side rails 16 and 17, but are slidable in the receivers 38 during assembly and during certain modifications of the diffuser 1.

Each bridge 22 has a bottom or lower wall 44 and a top or an upper wall 45 that each extend between the feet 41 and 42, are parallel to one another and are spaced by a partial rear wall 46. For each bridge 22 the lower wall 44, upper wall 45 and rear wall 46 form a blade receiving slot 48 therebetween that operably slidably receives the blades 23 and is sufficiently wide to receive the width and thickness of the blades 23. The rear wall 46 has a central aperture 47 located therein. Each of the slot lower walls 44 include a pair of spaced rests 51 mounted thereon that are cylindrical in shape and protrude upwardly from the surface of the lower wall 44 to expose a semi-circular surface 49. The rests 51 are aligned parallel to the frame rails 16 and 17 and are spaced from each other. The rear wall aperture 47 includes a portion 52 that is located just laterally with respect to the rests 51.

Mounted in each of the slots 48 between the rests 51 is a spring arm or member 56. Each spring member 56 includes a mounting post 59 that extends between the lower wall 44 and upper wall 45 in close proximity to the rear wall 46 and a spring 60. Each spring 60 is elongate and curves so as to be arcuate and bowed outwardly from the rear wall 46. Each spring 60 is positioned to engage the blades 23 associated therewith, as will be discussed below.

Figures 2, 3, 4:
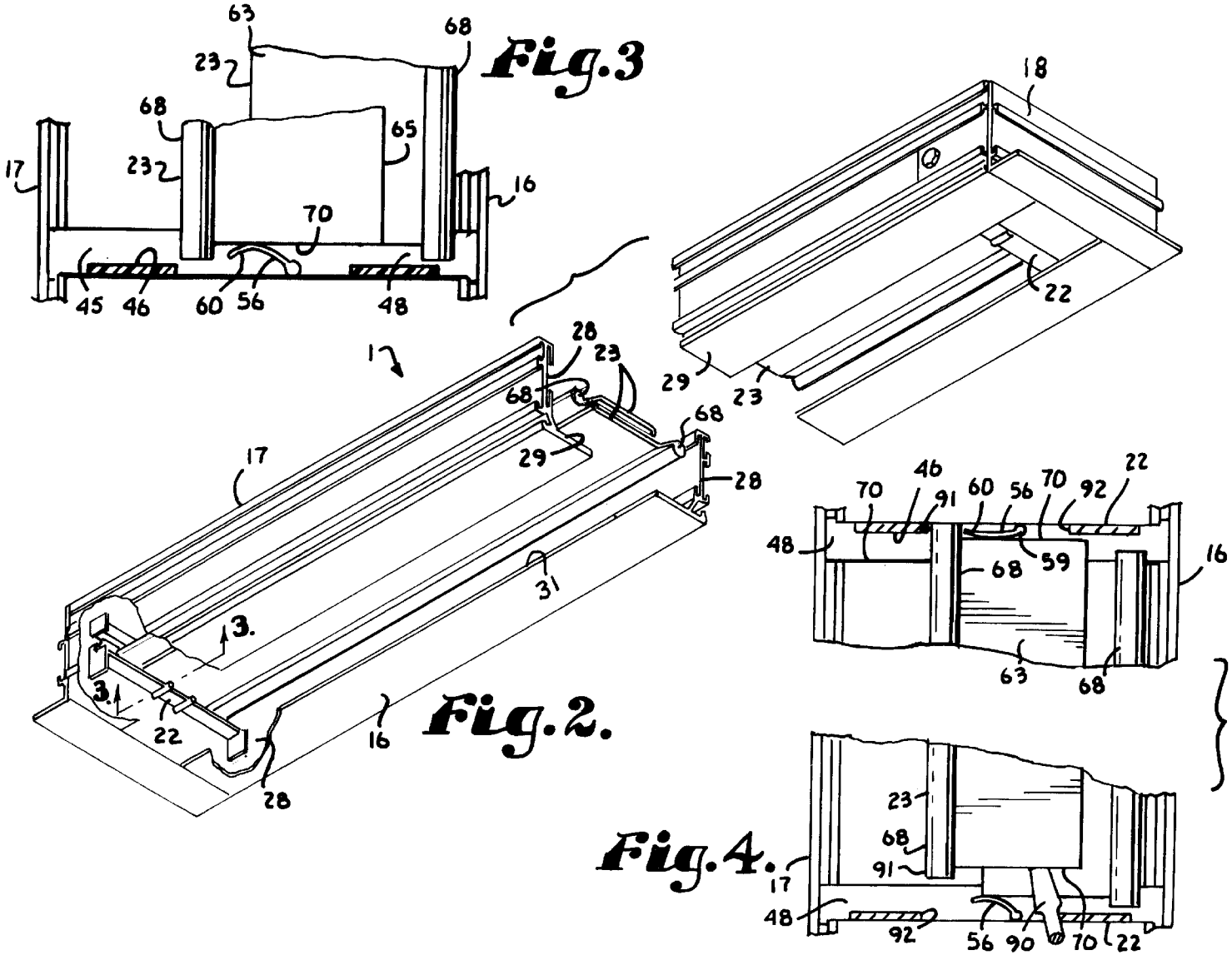
FIG. 2 is a perspective view of the diffuser, looking up at the diffuser, on an enlarged scale, with portions broken away to illustrate detail thereof.
FIG. 3 is a fragmentary cross-sectional view of the diffuser, taken along line 3—3 of FIG. 2, showing a pair of a first type of air control blades positioned for use in controlling air flow.
FIG. 4 is a fragmentary cross-sectional view of the diffuser similar to FIG. 3, but showing one of the blades being biased toward a bridge that is located at the top of the view by a screwdriver.

Each bridge 22 has an upper curved or arcuate cover 61 (see FIG. 8) that extends the entire length thereof between the side rails 16 and 17 and that is rounded with a radius that is approximately equal to the thickness of the bridge 22, forming a quarter round that allows smooth transition with the slot upper wall 45. The rounded feature of the surface of the cover 61 reduces drag and turbulence of air across the bridge 22 and thus reduces noise created by air passing the associated bridge 22. Each of the first set of blades 23 (see FIGS. 3 and 4) includes a generally planar and elongate portion 63 joined along an edge thereof to a rectangular lip 65 that is slightly larger in thickness than the planar portion 63 and at an opposite end to a ramp 67 that in turn is joined to a round rod 68 that is comparatively larger in diameter than the thickness of the planar portion 63. The rod 68 is approximately the same size as the slot 48 so that an end 70 thereof is received completely therein in such a manner as to allow the blades 23 to slide laterally within the slots 48, but be supported by the ends 70. The rods 68 are slightly longer than the remaining parts of each blade 28, including the planar portion 63, ramp 67 and lip 65. In this manner the rods 63 are received further into the slot 48 then the remaining portions of the blade 23 (FIG. 3). As is seen in FIGS. 3 and 4, the planar portions 63 of the blades 23 are supported on the rests 51 and ends 70 of each of the first set of blades 23 abut against a respective spring 60 during normal use.

Figure 8:
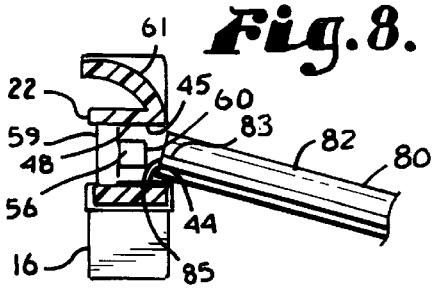
FIG. 8 is a fragmentary and cross-sectional view of a bridge, taken along line 8—8 of FIG. 6, with the first of the second set of blades being urged into a slot of the bridge.
Figure 9:
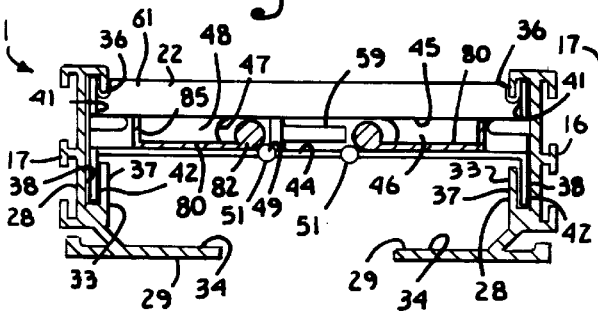
FIG. 9 is a cross-sectional view of the diffuser, taken along line 9—9 of FIG. 7, showing the second set of air control blades inserted in the bridge slot and positioned in an installation configuration.

A second set of interchangeable and alternative blades 80 is seen in FIGS. 7 to 10. Each of the second set of blades includes a planar portion 81 having a rod 82 attached to and extending longitudinally along one side thereof. The rod 82 is longer than the planar portion 81 forming slot following pegs 83 on each end 85 of the blade 80. Each blade 80 also includes a foot 85 secured to an edge of the planar portion 81 opposite the pegs 83 and being sized, shaped and positioned to slide along the side rail flange 29 (see FIG. 10) when installed in the diffuser 1. Each foot 85 is also sized to fit into the bridge slot 48 with the rest of the blade end 85 during installation and removal, as is shown in FIG. 9.

In use the diffuser 1 is installed in a first or second configuration in a room 4. The first configuration is shown in FIGS. 1 to 3 with the first set of blades 23. The blades 23 may be moved as a pair laterally between the side rails 16 and 17 to position air flow space or may be moved with respect to each other to overlap more or less to enlarge or decrease the air flow space and consequently the volume of air flow.

Figure 5:
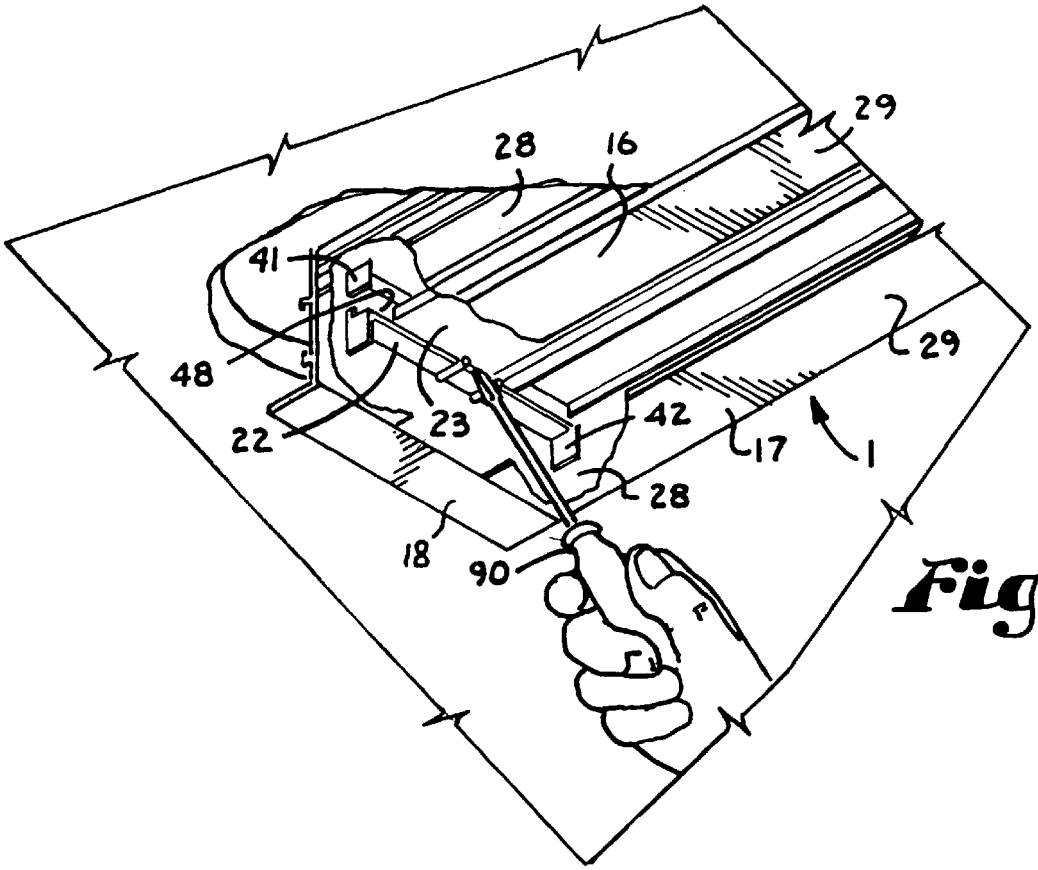
FIG. 5 is a perspective view of the diffuser and ceiling showing the blade in a similar position as is shown in FIG. 4 with a screwdriver biasing the blade generally to the right, side of FIG. 5.
Figure 6:
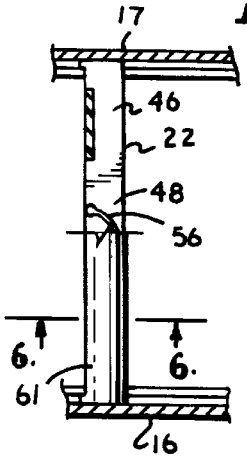
FIG. 6 is a fragmentary cross-sectional view of the diffuser similar to FIG. 3 except with the first set of blades removed.

When desired the first set of blades 23 may be removed by first applying pressure to one end 70 of a blade 23, as seen in FIGS. 4 and 5. The pressure may be applied manually directly or through the aid of a tool, such as a screwdriver 90, as shown. The blade 23 to which pressure is applied moves toward one bridge slot 48 and away from the opposite, pushing against a spring 60 and with a rod end 91 entering a bridge rear wall aperture 92, where necessary to have sufficient room to translate (see top of FIG. 4). The blade end 70 being urged away from the bridge 22 (see lower side of FIG. 4), clears the slot bottom wall 44 and is free to move toward the technician who then removes the first blade 23. The process is repeated for the second of the first set of blades 23. The bridge 22 is shown without blades in FIG. 6.

Figure 7:
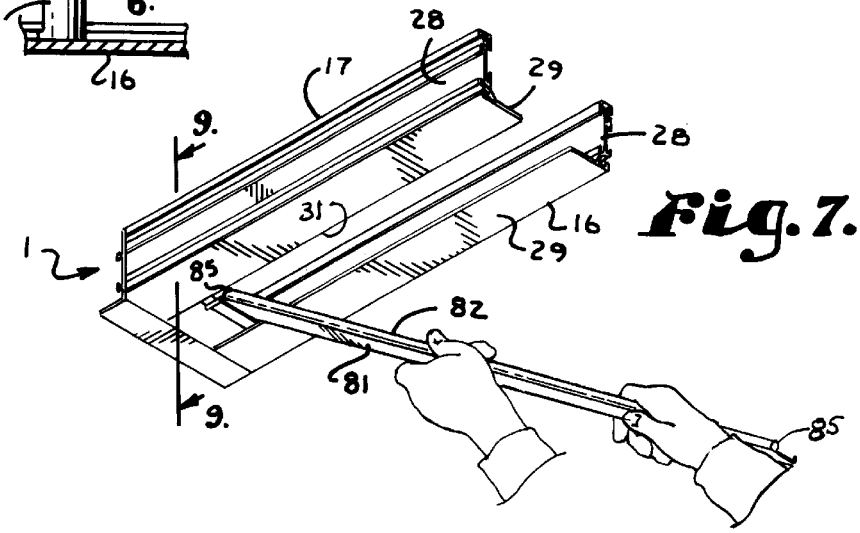
FIG. 7 is a perspective view of the diffuser showing an initial step of a first alternative blade of a second set of blades being installed in the diffuser.
Figure 10:
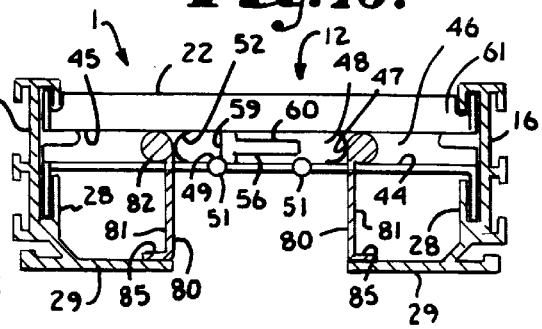
FIG. 10 is a cross-sectional view of the diffuser, similar to FIG. 9, showing the second set of diffuser blades rotated 90° as compared to FIG. 9 so as to be positioned in an operational configuration thereof.

A second set of blades 80 is then installed. As is shown in FIGS. 7 and 8, one end of a first of the second set of blades 80 is inserted in the bridge slot 48 with the blade 80 turned ninety degrees with respect to final installation (see FIG. 9). The first blade 80 is pushed from one end 85 or an intermediate location therealong into the slot 48 until the end 85 being pushed clears the bridge 22 and aligns with the opposite slot 48 at which time the blade 80 is centered between the bridges 22 and rotated so that the planar portion 81 hangs downwardly (as shown in FIG. 10). The first blade 80 is then laterally positionable within the slot 48 and a second blade 80 is installed in similar fashion. It is noted that the planar portion 63 of each of the first set of blades 23 is greater in length than the distance between the bridges 22, whereas the length of the planar portions 81 of the second set of blades 80 is less than the distance between the bridges 22.

The sets of blades 23 and 80 are fully interchangeable with each other without disassembling the diffuser 1 or any room structure about the diffuser 1.

It is to be understood that while certain forms of the present invention have been illustrated and described herein, it is not to be limited to the specific forms or arrangement of parts described and shown.

What is claimed and desired to be secured by Letters Patent is as follows:

1. An air diffuser for diffusing air into a room; said diffuser comprising:

a) a pair of side rails;

b) a pair of bridges joining and spacing said side rails; and including c) a first set of air control blades that are generally alignable perpendicularly with respect to air flow from top to bottom of the diffuser during use;

d) a second set of air control blades that are generally alignable parallel with respect to air flow from top to bottom of the diffuser during use; and e) said first and second sets of blades both being supported by said bridges during use and being interchangeable with one another without disassembly of a remainder of said diffuser.

2. An air diffuser comprising:

a) a pair of parallel and spaced side rails;

b) a pair of bridges joining and being supported by said side rails;

c) each of said bridges including an elongate and laterally extending slot; said pair of bridges having slots in facing relationship to each other; and including d) a first air control blade supported during use by said bridges; said first air control blade having ends received respectively in said slots; said first air control blade being removable from a remainder of said diffuser by biasing one end of said first air control blade toward a first of said slots until a second end of said first air control blade becomes free from a second of said slots; and e) a second air control blade interchangeable with said first air control blade after removal of said first air control blade.

3. An air diffuser comprising:

a) a pair of parallel and spaced side rails;

b) a pair of bridges joining and being supported by said side rails;

c) each of said bridges including an elongate and laterally extending slot; said pair of bridges having slots in facing relationship to each other;

d) a first set of air control blades operably supported during use by said bridges; each of said first set of air control blades having ends received respectively in said slots during use; said first set of air control blades being removable from a remainder of said diffuser by urging each of said first set of air control blades toward a first of said slots such that an end of the blade being so urged extends further into said slot than during operative use and until a second end of said each of said first set of air control blades becomes free from a second of said slots; and e) a second set of air control blades interchangeable with said first set of air control blades and mountable within said bridge slots after removal of said first set of air control blades.

4. The diffuser according to claim 3 wherein:

a) one of said sets of first and second air control blades is positioned generally perpendicular to normal air flow through said diffuser during usage and the other of said sets of first and second air control blades is positioned generally parallel to air flow through said diffuser during usage.

5. The diffuser according to claim 3 wherein:

a) at least one of said first and second set of said blades includes slot following posts extending outward therefrom that are received in said slots.

6. The diffuser according to claim 5 wherein:

a) said slots each have a rear wall associated therewith; and b) a portion of each said rear walls includes an aperture therein to receive a respective post of the blades having posts during removal and insertion thereof when such a blade having a post is urged further into a respective slot.

7. The diffuser according to claim 5 wherein:

a) a spring member is positioned in each slot to operably resist urging a blade further into a respective slot during exchange but said spring being able to be overcome by pressure on the blade produced by a technician.

8. A diffuser kit comprising:

a) a diffuser frame constructed of a pair of parallel and spaced side rails and a pair of spaced bridges;

b) a first set of air control blades providing a jet air configuration when installed and being supported by and laterally movable along said bridges; and c) a second set of air control blades providing a directional air configuration when installed and being supported by and laterally movable along said bridges; said first and second sets of blades being interchangeable without disassembly of a remainder of said diffuser.

9. A method of changing air control blades in an air diffuser comprising the steps of:

a) providing a diffuser having parallel side rails spaced by bridges;

b) providing a first set of blades and installing said blades such that ends thereof are supported in slots in said bridges;

c) thereafter removing said first set of blades without otherwise disassembling said diffuser by independently first urging one end of each blade further into a slot of one bridge such that such blade clears a slot associated with the other bridge; and d) thereafter providing a second set of blades and installing each of said second set of blades by reversing the process of the step of paragraph c.

* * * * *